US006582201B2

(12) United States Patent
Lucchi

(10) Patent No.: US 6,582,201 B2
(45) Date of Patent: Jun. 24, 2003

(54) SUPPORTING FRAME FOR A PORTABLE COMPRESSOR

(75) Inventor: Fabio Lucchi, Sasso Marconi (IT)

(73) Assignee: F.I.A.C. S.p.A., Pontecchio Marconi (IT)

( * ) Notice: Subject to any disclaimer, the term of this patent is extended or adjusted under 35 U.S.C. 154(b) by 31 days.

(21) Appl. No.: 09/843,828

(22) Filed: Apr. 30, 2001

(65) Prior Publication Data

US 2002/0131872 A1 Sep. 19, 2002

(30) Foreign Application Priority Data

Mar. 13, 2001 (IT) ..... BO01A0135

(51) Int. Cl.[7] ..... F04B 53/00

(52) U.S. Cl. ..... 417/234; 280/47.17; 280/47.315; 280/47.131

(58) Field of Search ..... 417/234; 280/47.131, 280/47.17, 47.315

(56) References Cited

U.S. PATENT DOCUMENTS 1,756,806 A * 4/1930 Beach ..... 417/234
2,285,215 A * 6/1942 Lotz ..... 417/234
2,804,259 A * 8/1957 Ralston ..... 417/234
2,812,895 A * 11/1957 Peeps ..... 417/234
2,826,354 A * 3/1958 Field ..... 417/234
3,697,095 A * 10/1972 Howell ..... 280/47.17
4,003,504 A * 1/1977 Johnson et al. ..... 417/234
4,077,747 A * 3/1978 Burenga ..... 417/234
5,147,182 A * 9/1992 Timmons ..... 417/234
5,201,638 A * 4/1993 Bieri ..... 417/234
5,217,238 A * 6/1993 Cyphers et al. ..... 280/652
6,375,437 B1 * 4/2002 Nolan ..... 417/234

FOREIGN PATENT DOCUMENTS

JP 52022108 A * 2/1977 ..... 417/234

* cited by examiner

*Primary Examiner*—Cheryl J. Tyler
(74) *Attorney, Agent, or Firm*—Browdy and Neimark, P.L.L.C.

(57) ABSTRACT

In a portable compressor having a support frame, a compression device, a storage unit and at least one transportation handle, the frame has at least a first and second base to protect and/or support the compressor itself; the first and second base lie, respectively, on a first and second plane substantially at right angles to each other; and the first base has two opposite ends connected respectively to the second base and to the handle.

20 Claims, 3 Drawing Sheets

SUPPORTING FRAME FOR A PORTABLE COMPRESSOR

BACKGROUND OF THE INVENTION

The present invention relates to a portable compressor.

Portable compressors of the known type generally comprise a portable support frame equipped with an air compression device and a storage unit comprising, in turn, one or more compressed air tanks.

In particular, portable compressors are known to have a frame comprising a base to protect and support the compressor and on which the compression device, the storage unit and, between these two, a handle for transporting the compressor are fixed. The handle extends transversally from the base and has a handgrip positioned on the side of the base opposite to the compression device and the storage unit in order to allow transportation and lifting of the compressor. According to numerous variations, one or more protective bars and/or plates may extend transversally from the base, generally positioned on the side of the storage unit opposite to the compressor device to protect the latter from any side knocks.

Portable compressors of this type are relatively bulky, not very easy to transport, especially in restricted spaces, and not particularly versatile in use.

SUMMARY OF THE INVENTION

The aim of this invention is to provide a portable compressor that overcomes the disadvantages of the prior art described above.

Accordingly, the invention provides a portable compressor of the type comprising a frame and, supported by said frame, a compressor device, a storage unit and at least one transportation handle; wherein said frame comprises at least a first and a second base to protect and/or support said compressor; said first and second base lying, respectively, on a first and second plane substantially at right angles to each other; and said first base having two opposite ends connected respectively to said second base and to said handle.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

DESCRIPTION OF THE PREFERRED EMBODIMENTS

Figure 1:
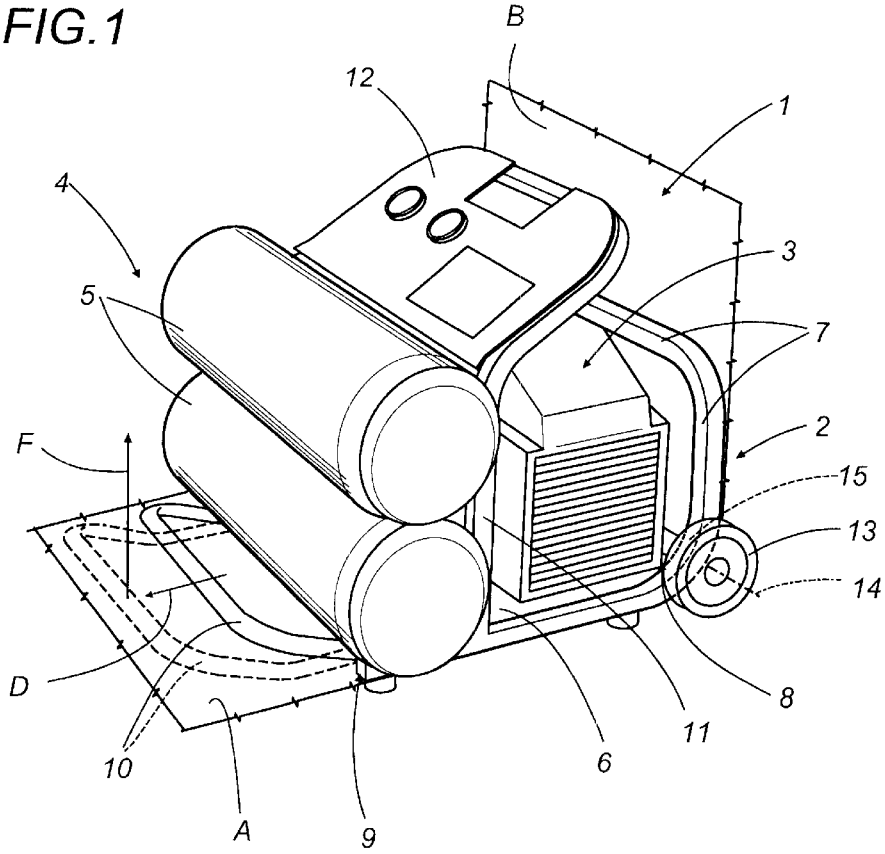
FIG. 1 is a schematic perspective view from above of a preferred embodiment of a portable compressor disclosed by this invention.

With reference to FIG. 1, the numeral 1 indicates as a whole an air compressor suitable for manual transportation by a user.

The compressor 1 comprises a support frame 2, which has a substantially tubular structure, and on which are mounted an air compression device 3 of the known type and a storage unit 4 comprising two compressed air tanks 5. In a variation which is not illustrated, there is a single tank instead of the two tanks 5.

The compression device 3 and the storage unit 4 are fixed to a first base 6 of the frame 2, which lies on a plane A and acts as a protective and stable support base for the compressor 1.

The frame 2 also comprises a second protective and stable support base 7 for the compressor 1, which lies on a plane B substantially at right angles to plane A. The second base 7 is, more specifically, defined by a U-shaped tubular portion of the frame 2.

The size of the first base 6 in a right-angled direction to plane B is greater than the size of the second base 7 in a right-angled direction to plane A. In other words, the entire compressor 1 extends primarily at right angles to the plane B in such a way that its overall dimensions at right angles to the plane A are relatively limited.

The first base 6 presents two opposite ends 8, 9 connected respectively to the second base 7 and to a main transportation handle 10 of the compressor 1, and the compression device 3 and the storage unit 4 are substantially arranged on it next to each other with the compression device 3 facing the second base 7 and with the storage unit 4 facing the handle 10. More specifically, the compression device 3 is protected, on one side, by the second base 7, and, on the other, by the storage unit 4 which has its two tanks 5 arranged next to each other and welded to each other substantially at right angles to the plane A. Between the compression device 3 and the storage unit 4 there is a tubular structure 11 supporting a control panel 12 of the compressor 1 and protecting the compression device 3 itself.

The handle 10 is telescopically extendable from the second base 6 in a direction D substantially lying on plane A and substantially at right angles to the plane B. In FIG. 1, the dashed line illustrates an extraction position of the handle 10 from the base 6.

On the side opposite the handle 10, the frame 2 supports two wheels 13, only one of which is visible in FIG. 1. More specifically, the wheels 13 turn about an axis 14 substantially parallel to a straight line intersecting planes A and B, being supported by the frame 2 at a portion 15 of the frame 2 itself in which the bases 6 and 7 converge upon each other.

The above-described compressor 1 is particularly easy to transport thanks to the position of the handle 10 with respect to the compressor 1 as a whole. The maneuverability of the compressor 1 is also increased by the presence of the wheels 13 and by the possibility of extending the handle 10 in the direction D.

Figure 2:
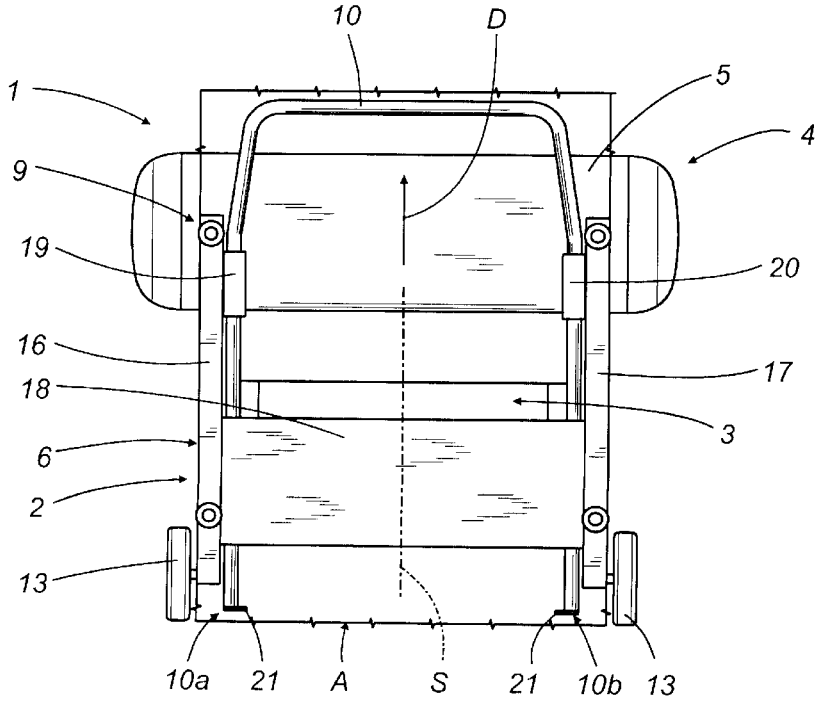
FIG. 2 is a perspective view from below of the portable compressor illustrated in FIG. 1.

For this purpose, as shown in FIG. 2, the first base 6 of the compressor 1 comprises two side portions 16, 17 of the frame 2 symmetrically opposite to an axis S of symmetry of the frame 2 itself, said axis S of symmetry lying on a first plane A and parallel to said direction D, and also comprising a platform 18 to support the compression device 3.

At said ends 9 of the first base 6, tubular sliding guides 19, 20 of the handle 10 are connected to the respective side portions 16, 17 of the frame 2.

Advantageously, with reference to FIG. 1, is extending the handle 10 to the dashed extended position increases the lever arm of a lifting force F of the compressor 1 which can be exercised by the user and therefore, under conditions of equal moment, the force F required to lift the compressor 1 rotating around the fulcrum consisting of the wheels 13 is considerably less.

Again with reference to FIG. 2, the handle 10 has two ends which are equipped with respective projecting striker elements 21, designed to engage with said tubular guides 19, 20 to determine the maximum extension of the handle 10 itself.

Figure 3:
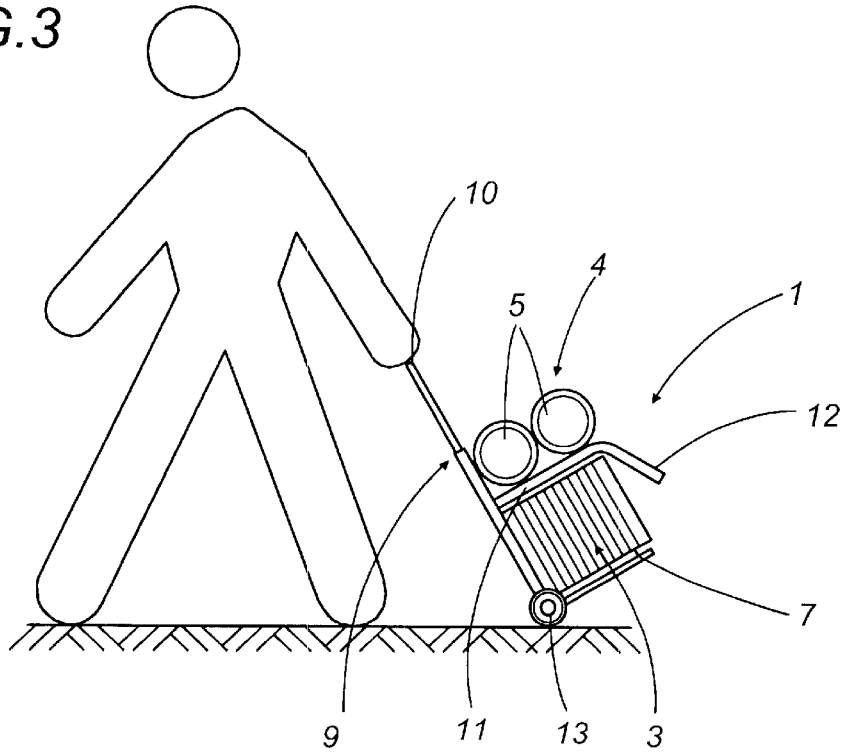
FIG. 3 is a schematic side view of the portable compressor illustrated in FIG. 1 in a transport configuration.

As illustrated in FIG. 3 and again with reference to the handle 10, a further advantage related to its extractability is provided by the fact that, although in the retracted position the overall dimensions of the compressor 1 are reduced, it allows the compressor 1 to be transported on the wheels 13 without requiring the user to bend, permitting him, instead, to move in an upright position.

Figure 4:
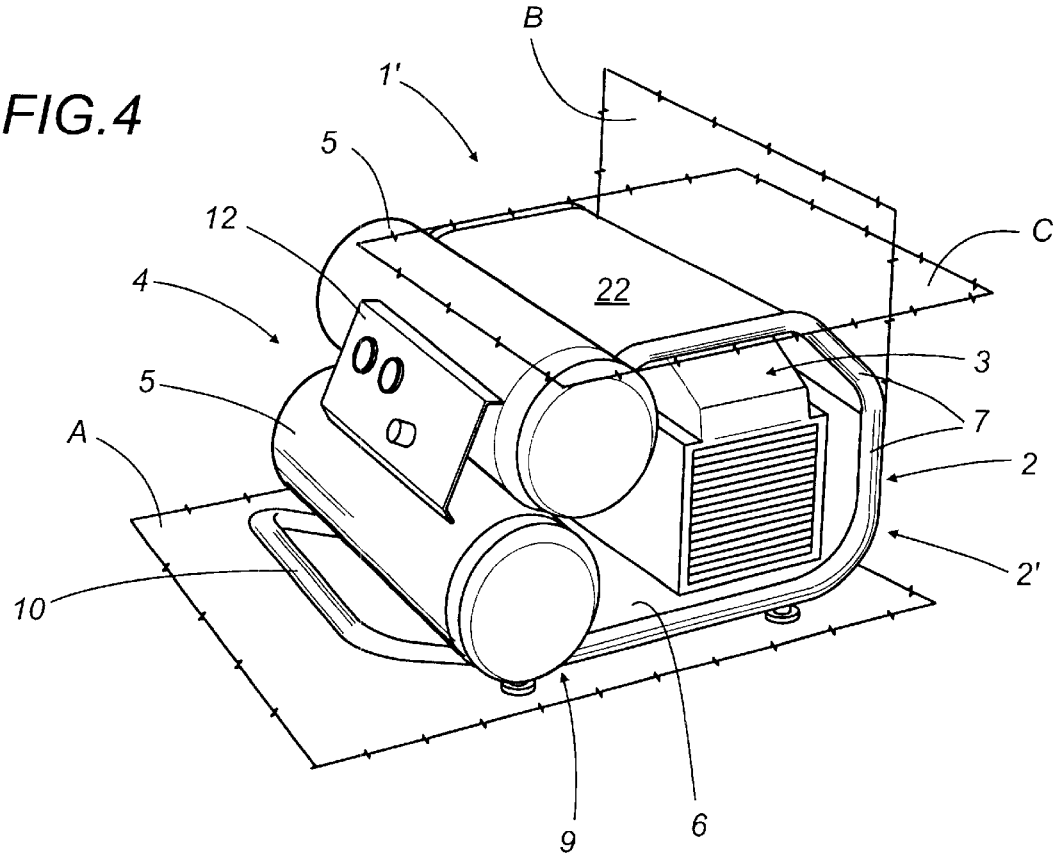
FIG. 4 is a perspective view from above of another embodiment of the portable compressor disclosed in this invention.

FIG. 4 shows another embodiment of the portable compressor disclosed in this invention.

The compressor in FIG. 4 is indicated as a whole with the numeral 1', but, to simplify the description, its component parts corresponding and similar to those already described with reference to the compressor 1 are indicated, in FIG. 4, with the same reference numbers used in FIG. 1.

The compressor 1' differs from the compressor 1 substantially in that its frame 2 comprises a third base 22, which is connected to the second base 7 and lies on a third plane C substantially parallel to plane A. The third base 22 defines a flat surface which the user can stand on and which also protects the compression device 3.

The bases 6, 7 and 22 enclose and protect the compression device 3 and define a portion 2' of the frame 2, which is cradle-shaped and welded in a single body to the two tanks 5 of the storage unit 4.

The two tanks 5 are positioned next to each other and welded together in an oblique direction with respect to plane A, and more specifically the tank 5 which is welded to the first base 6 is further away from the second base 7 than the tank 5 which is welded to the third base 22.

In this case too, according to a variation not illustrated, there may be a single tank instead of the two tanks 5.

The compressor 1' also differs from the compressor 1 in that the tubular structure 11 supporting the panel 12 is not present and the panel 12 is fixed to the two tanks 5 on the side opposite the compression device 3.

Furthermore, the compressor 1' presents a distribution of weight whereby its center of gravity on plane B projects beyond the second base 7. In this way, only the first base 6 of the two support bases 6 and 7 acts as a stable support for the compressor 1. This is particularly useful in cases in which the compression device 3 must necessarily function in a position in which the plane A is horizontal, for example to ensure that the lubrication of the internal parts is optimum.

Figure 6:
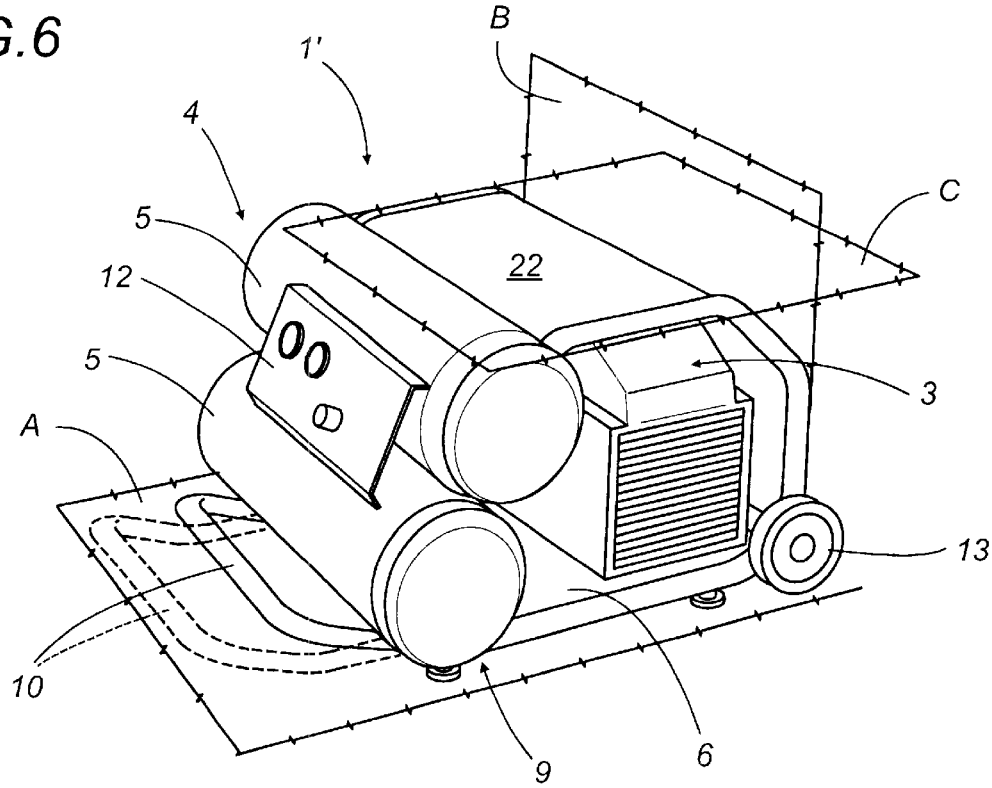
FIG. 6 is a perspective view from above of another embodiment of the portable compressor illustrated in FIG. 4.

As illustrated in FIG. 4, in the compressor 1', the handle 10 is rigidly fixed to the end 9 of the first base 6 and the wheels 13 are not present, while according to what is shown in FIG. 6, the handle 10 and the wheels 13 can be provided with the same functions described with reference to the compressor 1.

Figure 5:
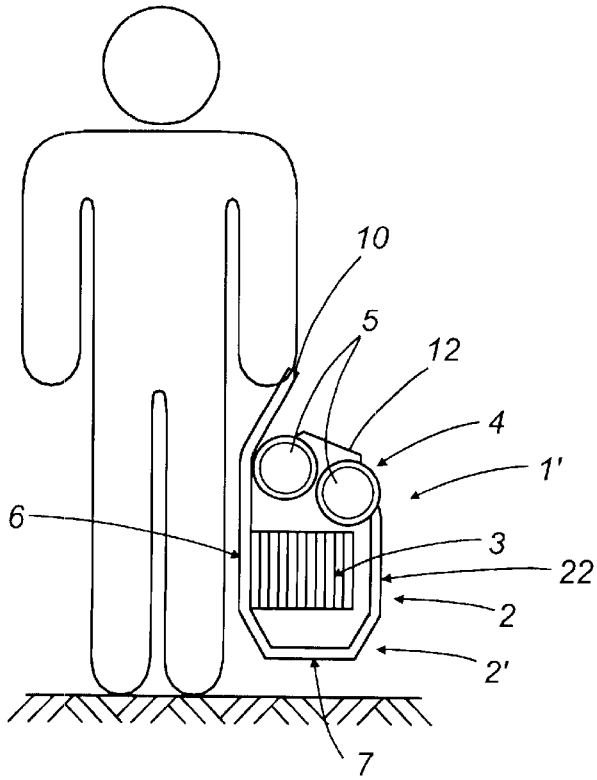
FIG. 5 is a schematic side view of the portable compressor illustrated in FIG. 4 in a transport configuration.

Advantageously, as illustrated in FIGS. 4 and 5, the compressor 1' is particularly easy to transport by carrying, especially in tight spaces, because of its particularly limited dimensions in a right-angled direction to plane A.

In this connection, in fact, said weight distribution allows a substantially vertical transport position-of the compressor 1' next to the user's legs. This vertical position, together with the compact configuration free of projections of the compressor 1' and the protection of the same guaranteed by the three bases 6, 7 and 22, reduces both the risk of accidental knocks during transport and the possibility that these knocks can cause damage to the compressor 1' itself.

The compressor 1' is therefore particularly resistant to knocks thanks to the presence of the third protective base 22, which also increases the versatility of use of the compressor 1' itself by defining, with a surface that can be stood on, a useful step for the user and a support surface for tools or other items.

What is claimed is:

1. A portable compressor frame comprising;

a compression device, a storage unit and at least one transportation handle all engaged on a first base of the frame; wherein said frame comprises at least the first base and a second base to protect and/or support said compressor device; said first and second bases lying, respectively, on a first and second plane substantially at right angles to each other; and said first base having two opposite ends connected respectively to said second base and to said handle;

wherein said handle is engaged on said first base and is telescopically extendable from said first base in a direction substantially coplanar to said first plane and substantially at right angles to said second plane.

2. The compressor frame according to claim 1, wherein said compression device and said storage unit are supported by said first base.

3. The compressor according to claim 2, wherein said compression device and said storage unit are positioned substantially next to each other on said first base, said compression device facing said second base and said storage unit facing said handle.

4. The compressor frame according to claim 1, having two wheels which are mounted on said frame where said first and second bases converge toward each other.

5. The compressor frame according to claim 1, wherein said frame comprises a third base connected to said second base and lying on a third plane substantially parallel to said first plane.

6. The compressor frame according to claim 5, wherein said storage unit is fixed to a free end of said first base and to the third base.

7. The compressor frame according to claim 6, wherein said third base defines a surface that can be stood on.

8. The compressor frame according to claim 1, wherein an area of said first base is greater than an area of said second base.

9. The compressor frame according to claim 1, wherein said frame has a substantially tubular structure.

10. The compressor frame according to claim 1, wherein said storage unit comprises at least one compressed air tank.

11. The compressor frame according to claim 1, wherein said compressor is fixed on said first base.

12. The compressor frame according to claim 1, wherein a support wall fixed to the first base is provided between the compressor device and the storage unit, the support wall having a control panel on a free end thereof.

13. A portable compressor frame comprising;

a compression device, a storage unit and at least one transportation handle all engaged on a first base of the frame; wherein said frame comprises at least the first base and a second base to protect and/or support said compressor device; said first and second bases lying, respectively, on a first and second plane substantially at right angles to each other; and said first base having two opposite ends connected respectively to said second base and to said handle;

wherein said frame comprises a third base connected to said second base and lying on a third plane substantially parallel to said first plane.

14. The compressor frame according to claim 13, wherein said storage unit is fixed to a free end of the first base and to the third base.

15. The compressor frame according to claim 14, wherein said third base defines a surface that can be stood on.

16. The compressor frame according to claim 13, wherein the compressor device is engaged to the first base and the third base.

17. The compressor frame according to claim 13, wherein the handle is fixed to the first base.

18. The compressor frame according to claim 13, wherein the storage unit forms a surface that lies in a plane which is inclined to the first base.

19. The compressor frame according to claim 18, wherein a control panel is mounted on the inclined surface formed by the storage unit.

20. The compressor frame according to claim 13, having two wheels are mounted on said frame where said first and second bases converge toward each other.

* * * * *